US009816409B2

(12) United States Patent
Choi et al.

(10) Patent No.: US 9,816,409 B2
(45) **Date of Patent: *Nov. 14, 2017**

(54) VARIABLE VALVE LIFT APPARATUS

(71) Applicant: Hyundai Motor Company, Seoul (KR)

(72) Inventors: Myungsik Choi, Seoul (KR); Gee Wook Shin, Hwaseong-si (KR); Won Gyu Kim, Seoul (KR); Gyu Han Hwang, Yongin-si (KR); Young Hong Kwak, Suwon-si (KR); Yoonsik Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 75 days.

This patent is subject to a terminal disclaimer.

(21) Appl. No.: 14/737,776

(22) Filed: Jun. 12, 2015

(65) Prior Publication Data

US 2016/0160707 A1 Jun. 9, 2016

(30) Foreign Application Priority Data

Dec. 9, 2014 (KR) ..... 10-2014-0175829

(51) Int. Cl.
*F01L 1/18* (2006.01)
*F01L 13/00* (2006.01)

(52) U.S. Cl.
CPC ..... *F01L 13/0021* (2013.01); *F01L 1/18* (2013.01); *F01L 2001/186* (2013.01)

(58) Field of Classification Search
CPC .... F01L 1/18; F01L 13/0021; F01L 2001/186
USPC ..... 123/90.39, 90.44, 90.45, 90.16
See application file for complete search history.

(56) References Cited

U.S. PATENT DOCUMENTS 8,028,668 B2 * 10/2011 Choi ..... F01L 1/18 123/90.39
9,587,531 B2 * 3/2017 Choi ..... F01L 1/185 123/90.39

FOREIGN PATENT DOCUMENTS

| | | | |
|---|---|---|---|
| JP | 2008-184962 | A | 8/2008 |
| JP | 2012-087761 | A | 5/2012 |
| KR | 10-2007-0050368 | A | 5/2007 |
| KR | 10-0921045 | B1 | 10/2009 |
| KR | 10-2010-0062347 | A | 6/2010 |
| KR | 10-1234643 | B1 | 2/2013 |

* cited by examiner

*Primary Examiner* — Ching Chang
(74) *Attorney, Agent, or Firm* — Morgan, Lewis & Bockius LLP

(57) ABSTRACT

A variable valve lift apparatus to vary lift of a valve disposed at an engine may include an outer body selectively making a lever motion according to rotation of a cam, being adapted such that the valve is connected with one end thereof and a pivot axis of the lever motion is disposed at another end thereof, and forming an inside space, an inner body disposed in the inside space of the outer body and adapted such that one end thereof is rotatably connected with the one end of the outer body, a connecting shaft disposed so as to penetrate the one end of the outer body and the one end of the inner body and connect the outer body with the inner body, and a lost motion spring provided so as to return the inner body which is relatively rotated with the outer body around the connecting shaft.

7 Claims, 5 Drawing Sheets

VARIABLE VALVE LIFT APPARATUS

CROSS-REFERENCE TO RELATED APPLICATION

The present application claims priority to Korean Patent Application No. 10-2014-0175829 filed Dec. 9, 2014, the entire contents of which is incorporated herein for all purposes by this reference.

BACKGROUND OF THE INVENTION

Field of the Invention

The present invention relates to a variable valve lift apparatus. More particularly, the present invention relates to a variable valve lift apparatus supported by four points of two valves and two hydraulic lash adjusters.

Description of Related Art

Generally, an internal combustion engine receives fuel and air into a combustion chamber and generates power by combusting the fuel and the air. Herein, an intake valve is operated by drive of a camshaft, and air flows into the combustion chamber while the intake valve is open. In addition, an exhaust valve is operated by drive of a camshaft, and air is exhausted from the combustion chamber while the exhaust valve is open.

Meanwhile, optimal operations of the intake valve or the exhaust valve are determined according to rotation speed of the engine. That is, lift and open/close timing of the valves are properly controlled according to rotation speed of the engine. A variable valve lift (VVL) apparatus has been developed in which the valves are operated for various lifts according to rotation speed of the engine for realizing optimal operations of the valves according to rotation speed of the engine. For example, there is a variable valve lift apparatus in which a plurality of cams for operating the valves by each different lift are provided to the camshaft, and the cam operating the valves is selected according to conditions.

When the plurality of cams are provided to the camshaft, however, the composition for selectively changing the cam to operate the intake valve or the exhaust valve may become complex, and interference between the elements of the composition may occur. Meanwhile, in case the plurality of cams are respectively and independently operated for preventing the interference between the elements of the composition, an additional constituent element is required as each cam for operating the cam such that the cost may be increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift apparatus having advantages of varying valve lift by one cam, having further advantages of realizing deactivation of a cylinder by varying valve lift, and of varying lift of two valves and simultaneously improving spatial utility and dynamic characteristics.

According to various aspects of the present invention, a variable valve lift apparatus which is driven to vary lift of a valve disposed at an engine may include an outer body selectively making a lever motion according to rotation of a cam, being adapted such that the valve may be connected with one end thereof and a pivot axis of the lever motion may be disposed at another end thereof, and forming an inside space of the outer body, an inner body disposed in the inside space of the outer body and adapted such that one end thereof may be rotatably connected with the one end of the outer body, a connecting shaft disposed to penetrate the one end of the outer body and the one end of the inner body and connect the outer body with the inner body, and a lost motion spring provided to return the inner body which may be relatively rotated with the outer body around the connecting shaft, in which the inner body may be selectively fixed to the outer body so as to make a lever motion together with the outer body around the pivot axis of the outer body lever motion according to the rotation of the cam or may be selectively released from fixing with the outer body so as to make a lever motion around the connecting shaft according to the rotation of the cam, and the outer body forms valve contact portions which are protruded from both sides of the one end thereof so as to respectively push one valve by the lever motion and seated portions which are protruded from both sides of the other end of the outer body so as to respectively seat one hydraulic lash adjuster.

The inner body may form an inside space, and the variable valve lift apparatus may further include a roller which may be disposed in the inside space of the inner body, may be rotatably connected with the inner body, and may be rolling-contacted to the cam such that the inner body makes the lever motion according to the rotation of the cam.

A stopper may be protrudingly formed at the other end of the inner body to blocking the other end of the outer body when the inner body may be returned.

The lost motion spring may be disposed to be coiled around the connecting shaft and may be adapted such that one part thereof may be fixed to the outer body and another part thereof may be fixed to the inner body.

The one part of the lost motion spring may be extended without interference with the inner body so as to be fixed to the one end of the outer body.

The outer body may be integrally formed with the connecting shaft, and the one part of the lost motion spring may be fixed to the outer body by being fixed to the connecting shaft.

The inside space of the outer body may be opened toward the one end side of the outer body such that an entire shape of the outer body may be formed in a "U" shape.

The inner body includes a stopper, an inner connecting hole, a roller hole, and a latching pin hole.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
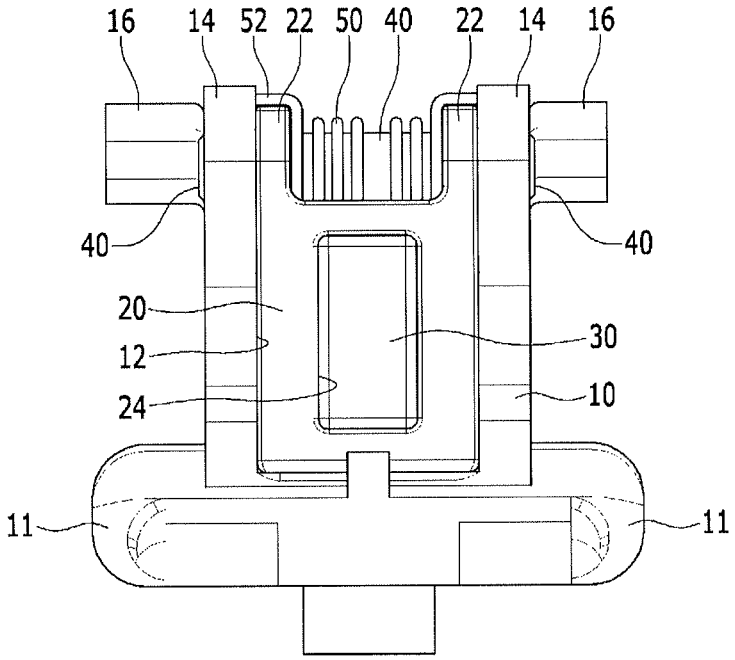
FIG. 1 is a top plan view of an exemplary variable valve lift apparatus according to the present invention.
Figure 2:
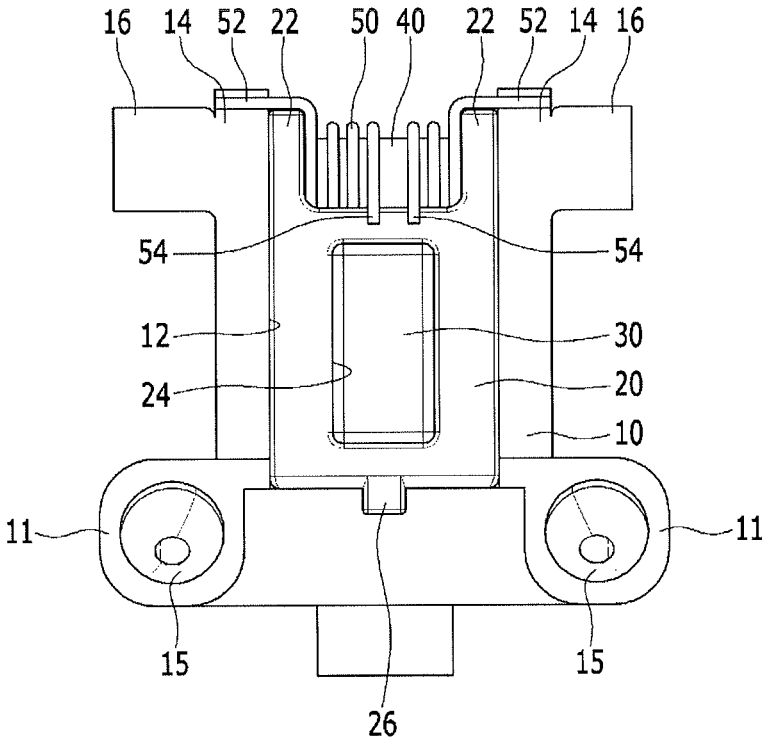
FIG. 2 is a rear view of the exemplary variable valve lift apparatus according to the present invention.

FIG. 1 is a top plan view of a variable valve lift apparatus according to various embodiments of the present invention, and FIG. 2 is a rear view of a variable valve lift apparatus according to various embodiments of the present invention.

As shown in FIG. 1 and FIG. 2, a variable valve lift apparatus according to various embodiments of the present invention includes an outer body 10, an inner body 20, a roller 30, a connecting shaft 40, and a lost motion spring 50.

The outer body 10 makes a lever motion according to selectively receive torque of a camshaft, and operates so as to open/close a valve. In addition, a cam is formed or disposed at the camshaft so as to transform a rotational motion of the camshaft to a lever motion of the outer body 10. Herein, the valve is an intake valve or an exhaust valve of an engine. A space 12 that the outer body 10 penetrates in a vertical direction is formed inside of the outer body 10. That is, the outer body 10 has a set length so as to make a lever motion, and has a set width and a set thickness so as to form the inside space 12 of the outer body 10.

The valve is connected to one end of the outer body 10, and a rotation axis of the lever motion is disposed at the other end thereof. In addition, the inside space 12 of the outer body 10 is opened toward the one end side of the outer body 10 such that an entire shape of the outer body 10 is formed in a "U" shape.

In description hereinafter, one end and the other end of each elements which are connected to or disposed at the outer body 10 mean a portion on the same side with the one end and the other end of the outer body 10.

The inner body 20 is disposed in the inside space 12 of the outer body 10. In addition, one end of the inner body 20 is rotatably connected with one end of the outer body 10. The inner body 20 makes a lever motion according to receive torque of the camshaft, and operates so as to selectively open/close a valve. A space 24 that the inner body 20 penetrates in a vertical direction is formed inside of the inner body 20. That is, the inner body 20 has a set length so as to make a lever motion, and has a set width and a set thickness so as to form the inside space 24 of the inner body 20.

The roller 30 is disposed in the inside space 24 of the inner body 20. In addition, the roller 30 is rotatably connected with the inner body 20. Further, the roller 30 is rolling-contacted with the cam so as to transform a rotational motion of the camshaft to a lever motion of the outer body 10 or the inner body 20.

The connecting shaft 40 is provided so as to rotatably connect the one end of the outer body 10 with the one end of the inner body 20. That is, the inner body 20 may be relatively rotated with the outer body 10 around the connecting shaft 40. Herein, the one end of the outer body 10 which is connected with the inner body 20 by the connecting shaft 40 will be called "outer connecting portion 14", and the one end of the inner body 20 which is connected with the outer body 10 by the connecting shaft 40 will be called "inner connecting portion 22".

A valve contact portion 16 protruded from the outer connecting portion 14 is formed at the end of the outer body 10. The outer connecting portion 14 is formed as two at the one end of the outer body 10 opened toward the one end side. Therefore, the valve contact portion 16 is respectively protruded from the two outer connecting portions 14 toward the outside. In addition, the valve contact portion 16, which contacts the valve or valve opening/closing unit for opening/closing the valve, functions to push the valve according to the lever motion of the outer body 10.

Herein, the outer connecting portion 14 is formed at both sides of the inside space 12 in a width direction of the outer body 10, and the valve contact portion 16 is respectively protruded from both outer connecting portions 14 so as to function to push each valve. In addition, a seated portion 11 for seating a hydraulic lash adjuster (HLA) is formed at the other end of the outer body 10.

The seated portions 11 may be formed as two so as to be respectively protruded from the other end of the outer body 10 toward both sides. A seated groove 15 is respectively formed at the two seated portions 11 so as to seat each hydraulic lash adjuster. That is, the variable valve lift apparatus according to various embodiments of the present invention is supported by four points of two valves and two hydraulic lash adjusters. Herein, the hydraulic lash adjuster is a device for supplying the hydraulic pressure to operate the variable valve lift apparatus as well as making a valve lifter to always move in close contact with the cam, of which detailed description will be omitted as the device is well known to a person of ordinary skill in the art.

When the inner body 20 is fixed to the outer body 10, the inner body 20 and the outer body 10 make a lever motion together around the rotation axis of the outer body 10 lever motion by rotation of the cam rolling-contacted with the roller 30. Herein, it is well-known to a person of ordinary skill in the art that the rotation axis of the outer body 10 lever motion is pivot-axis formed with respect to the hydraulic lash adjuster. In addition, only the inner body 20 makes a lever motion around the connecting shaft 40 by rotation of the cam rolling-contacted with the roller 30 when the inner body 20 fixed to the outer body 10 is released.

In case the inner body 20 is released from the outer body 10, the lost motion spring 50 functions to return the inner body 20 which is made by a relative rotation with the outer body 10 by a lever motion. In addition, the lost motion spring 50 is disposed to be coiled around the connecting shaft 40.

The lost motion spring 50 forms an outer fixing portion 52 which is fixed to the outer body 10 and an inner fixing portion 54 which is fixed to the inner body 20. In addition, the outer fixing portion 52 may extend along a width direction of the outer body 10 to not be interfered with by the inner body 20, and may be fixed to the outer connecting portion 14 of the outer body 10. Herein, the outer fixing portion 52 may be fixed to the outer body 10 by being fixed to the connecting shaft 40 in case that the outer body 10 is integrally formed with the connecting shaft 40.

As the lost motion spring 50 is disposed to be coiled around the connecting shaft 40, the lost motion spring 50 is easily fixed to the inner body 20, and additional constituent elements for connecting the lost motion spring 50 with the outer body 10 or the inner body 20 are not required. For instance, in case that the lost motion spring 50 is disposed to be coiled around the rotation axis of the outer body 10 lever motion and one part of the lost motion spring 50 is connected with the inner body 20 through a rotation shaft 35 of the roller 30, length of the roller rotation shaft 35 may become long, and additional constituent elements for coiling the lost motion spring 50 around the rotation axis of the outer body 10 lever motion may be required.

Figure 3:
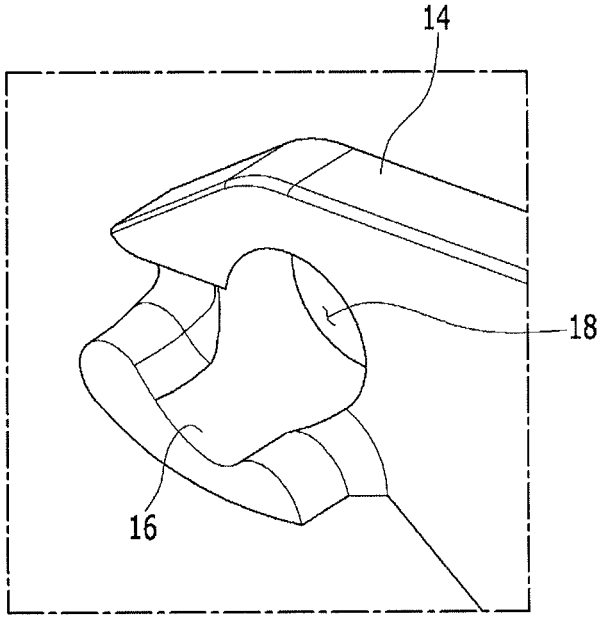
FIG. 3 is a perspective view which shows an outer body connecting hole according to an exemplary embodiment of the present invention.

FIG. 3 is a perspective view which shows an outer body connecting hole according to various embodiments of the present invention.

As shown in FIG. 1 and FIG. 3, the connecting shaft 40 is disposed so as to penetrate the outer connecting portion 14 of the outer body 10. That is, an outer connecting hole 18 is formed at the outer connecting portion 14 of the outer body 10 such that the connecting shaft 40 is inserted therein. In addition, the entire width of the outer body 10 except the valve contact portion 16 and length of the connecting shaft 40 may become short as the valve contact portion 16 is formed to be protruded from the outer connecting portion 14 toward both sides in a width direction of the outer body 10.

Figure 4:
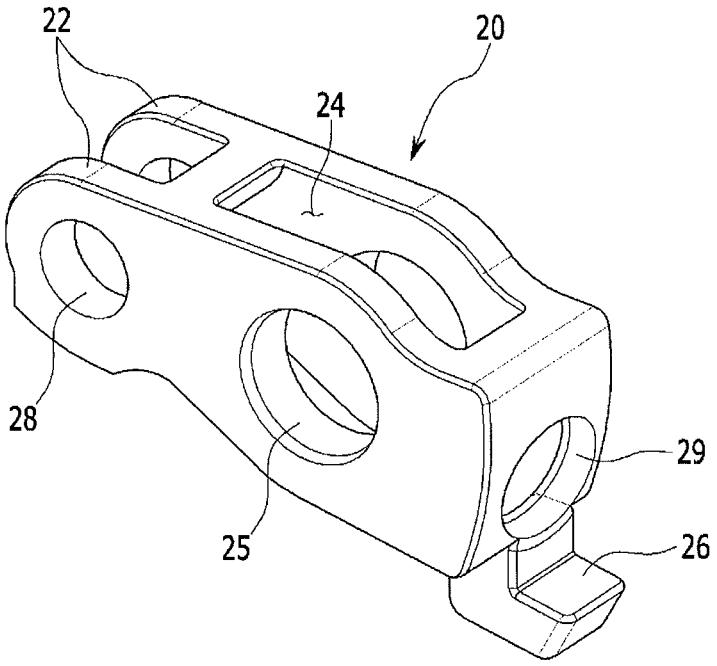
FIG. 4 is a perspective view of an inner body according to an exemplary embodiment of the present invention.
Figure 5:
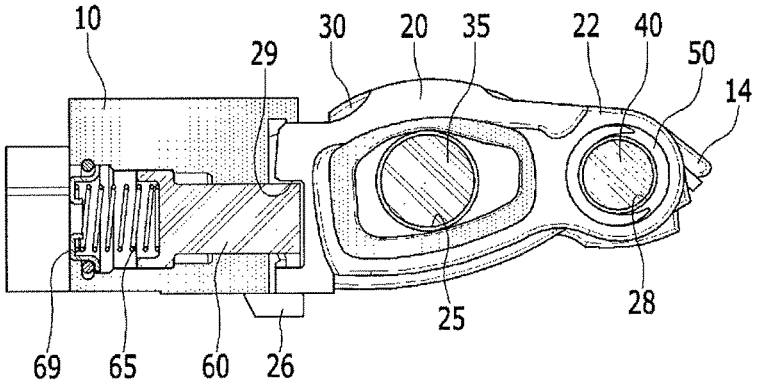
FIG. 5 is a cross-sectional view of the variable valve lift apparatus according to an exemplary embodiment of the present invention.

FIG. 4 is a perspective view of an inner body according to various embodiments of the present invention, and FIG. 5 is a cross-sectional view of a variable valve lift apparatus according to various embodiments of the present invention.

As shown in FIG. 4 and FIG. 5, the inner body 20 further includes a stopper 26, an inner connecting hole 28, a roller hole 25, and a latching pin hole 29.

The stopper 26 is formed to be protruded from the other end of the inner body 20 such that the other end of the inner body 20 is blocked by the other end of the outer body 10 when the inner body 20 reaches an original position by the lost motion spring 50 (referring to FIG. 2). Therefore, the inner body 20 may be stably returned by the lost motion spring 50.

The inner connecting hole 28 is a hole to be formed such that the connecting shaft 40 which is disposed so as to penetrate the inner connecting portion 22 of the inner body 20 is inserted therein, and the roller hole 25 is a hole to be formed such that the roller rotation shaft 35 is inserted therein. That is, the inner connecting hole 28 and the roller hole 25 are formed by boring the inner body 20 along a width direction.

The latching pin hole 29 is a hole to be formed such that a fixing member such as a latching pin 60 to function for selectively fixing the inner body 20 to the outer body 10 is inserted therein. While the fixing member is shown as the latching pin 60 in FIG. 5, it is not limited thereto. The latching pin 60 may be disposed at the other end side of the outer body 10 for easily receiving hydraulic pressure.

The inner body 20 may be fixed to the outer body 10 as the latching pin 60 is inserted into the latching pin hole 29 by elastic force of a latching spring 65. That is, the latching spring 65 is disposed such that one end thereof pushes the latching pin 60 toward the inner body 20. In addition, a spring seating unit 69 is provided for seating the other end of the latching spring 65 to the outer body 10. Further, the inner body 20 may be fixed with the outer body 10 as the latching pin 60 is pushed in an opposite direction by hydraulic pressure supplied from the hydraulic lash adjuster. Fixing and releasing of the inner body 20 which is selectively fixed to the outer body 10 by using the latching pin 60 and so on are well-known to a person of ordinary skill in the art, so a detailed description thereof will be omitted.

Meanwhile, tolerance between the latching pin 60 and the latching pin hole 29 may be precisely optimized as the outer body 10 and the inner body 20 are processed with respect to the stopper 26 when processing the outer body 10 and the inner body 20.

According to various embodiments of the present invention, power loss which occurs by friction with the cam may be minimized as lift of two valves are varied by the lever motion of the inner body 20 which is rolling-contacted with one cam. In addition, the cylinder deactivation may be realized as only the inner body 20 rolling-contacted with the cam makes the lever motion. Further, length of the connecting shaft 40 may become short as the lost motion spring 50 is disposed at the valve contact portion 16 and thus the entire size of the variable valve lift apparatus may be reduced, weight and cost of the variable valve lift apparatus may be decreased, and spatial utility and dynamic characteristics may be improved.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable valve lift apparatus which is driven to vary lift of a valve disposed at an engine, the variable valve lift apparatus comprising:

an outer body selectively making a lever motion according to a rotation of a cam, wherein the valve is connected with a first end of the outer body and a pivot axis of the lever motion is disposed at a second end of the outer body, and forming an inside space of the outer body;

an inner body disposed in the inside space of the outer body, wherein a first end of the inner body is rotatably connected with the first end of the outer body;

a connecting shaft disposed to penetrate the first end of the outer body and the first end of the inner body and connect the outer body with the inner body; and a lost motion spring provided to return the inner body which is relatively rotated with the outer body around the connecting shaft, wherein the inner body is selectively fixed to the outer body to make a lever motion together with the outer body around the pivot axis of the lever motion of the outer body according to the rotation of the cam or is selectively released from fixing with the outer body to make a lever motion around the connecting shaft according to the rotation of the cam, and wherein the outer body includes:

valve contact portions protruded from both sides of the first end of the outer body to respectively push one valve by the lever motion; and seated portions which are protruded from both sides of the second end of the outer body to respectively seat one hydraulic lash adjuster.

2. The variable valve lift apparatus of claim 1, wherein the inner body forms an inside space, and the variable valve lift apparatus further comprises a roller which is disposed in the inside space of the inner body, is rotatably connected with the inner body, and is rolling-contacted to the cam such that the inner body makes the lever motion according to the rotation of the cam.

3. The variable valve lift apparatus of claim 1, wherein a stopper is protrudingly formed at a second end of the inner body for blocking the second end of the outer body when the inner body is returned.

4. The variable valve lift apparatus of claim 1, wherein the lost motion spring is disposed to be coiled around the connecting shaft, wherein a first portion of the spring is fixed to the outer body and a second portion of the spring is fixed to the inner body.

5. The variable valve lift apparatus of claim 4, wherein the first portion of the lost motion spring is extended without interference with the inner body to be fixed to the first end of the outer body.

6. The variable valve lift apparatus of claim 4, wherein the outer body is integrally formed with the connecting shaft, and the first portion of the lost motion spring is fixed to the outer body by being fixed to the connecting shaft.

7. The variable valve lift apparatus of claim 1, wherein the inside space of the outer body is opened toward the first end of the outer body such that an entire shape of the outer body is formed in a "U" shape.

* * * * *